US006079822A

United States Patent [19]

Naganuma et al.

[11] Patent Number: 6,079,822

[45] Date of Patent: Jun. 27, 2000

[54] DRIVING METHOD OF PRINTING APPARATUS

[75] Inventors: Tohru Naganuma, Kanagawa; Masayuki Sato; Toru Nanbara, both of Tokyo; Takashi Aihara, Chiba; Takekatsu Matsumoto, Kanagawa, all of Japan

[73] Assignee: Sony Corporation, Tokyo, Japan

[21] Appl. No.: 08/944,427

[22] Filed: Oct. 6, 1997

[30] Foreign Application Priority Data

Oct. 7, 1996 [JP] Japan ..... P08-266161

[51] Int. Cl.[7] ..... B41J 2/17

[52] U.S. Cl. ..... 347/84; 347/95

[58] Field of Search ..... 347/84, 95, 100, 347/85

[56] References Cited

U.S. PATENT DOCUMENTS 5,958,122 9/1999 Fukuda et al. ..... 347/84 X

*Primary Examiner*—Richard Moses
*Attorney, Agent, or Firm*—Hill & Simpson

[57] ABSTRACT

In a driving method including a print head, it is possible to form surely dot of accurate concentration and to execute certain mixing and discharge actuation.

There is disclosed a driving method of a printer driving apparatus including a print head including a first pressure room into which a quantitative medium is introduced, a second pressure room into which a discharge medium is introduced, a first nozzle communicated with the first pressure room and a second nozzle communicated with the second pressure room formed wherein they are penetrated through a plate matter and opening parts of both nozzles are side by side, a first pressure applying means for pushing out the medium of the fixed quantity by applying pressure to the quantitative medium in the first pressure room and a second pressure applying means for discharge the discharge medium by applying pressure to the discharge medium in the second pressure room, the driving method characterized by including a process for making the first pressure applying means execute pushing out actuation from a stationary state and for making the medium of the fixed quantity leak out from the first nozzle to the opening part of the second nozzle on the plate matter and a process for making the second pressure applying means execute discharge actuation from the stationary state and for discharge the quantitative medium and the discharge medium by making the discharge medium discharge from a opening part of the second nozzle, and characterized by finishing the discharge actuation of the second pressure applying means after the pushing out actuation of the first pressure applying means.

8 Claims, 9 Drawing Sheets

DRIVING METHOD OF PRINTING APPARATUS

BACKGROUND OF THE INVENTION

1. Field of the Invention

The present invention relates to a driving method of a printer apparatus to mix and discharge a quantitative and a discharge medium, more particularly, to the driving method of the printer apparatus that is possible to surely the mixing and the discharge actuation by regulating timing the mixing and the discharge actuation of the quantitative and the discharge medium.

2. Description of the Related Art

Recently, document creating by using a computer called desktop publishing has become popular particularly at office, at present the request to output not only letters and figures but also color national images such as pictures with the letters and figures has increased. With this, it has been requested to print the high grade national images and gradation representation by intermediate representation has been important.

As so-called an on-demand type printer apparatus which discharges a drop of ink from a nozzle only when it is necessary to print according to a control signal corresponding to a recording signal, adheres it to a recorded material such as a paper and a film and records has a potential of a small size and low cost, it has recently been spreading.

Though various methods have been proposed as the methods for discharge the drop of ink from the nozzle, the method for using piezoelectric or exoergic elements is usual. The former is the method for discharge by applying pressure to the ink by deforming the piezoelectric elements. The latter is the method for discharge the ink by the pressure of bubble generated by heating and evaporating the ink by the exoergic elements.

As the method for executing pseudoly the gradation representation by the intermediate display by the on-demand type printer apparatus for getting the the drop of ink, various methods have been proposed. That is to say, as a first method, the method for controlling the size of the drop of ink discharge by changing voltage and a pulse width of a voltage pulse applied to the piezoelectric or the exoergic elements and representing gradation as a radius of the printing dot is variable is given.

However, in the first method, as the it is stopped to discharge the ink when the voltage and the pulse width to the piezoelectric or the exoergic elements are too reduced, there are disadvantages that the minimum radius of the drop of ink is limited, there is few the number of representable gradation steps and it is particularly very hard to represent a picture of low concentration. Therefore, it is unsatisfied to print out the national image.

As a second method, the method for forming by a matrix that, for example, a picture element is formed by 4×4 dots without changing the radius of the dot and for executing the gradation representation by a matrix unit by using the dither method is given.

However, in the second method, though it is possible to represent the concentration of 17 gradations when a picture element is formed by 4×4 matrix, in case of printing by using, for example, the same dot density as that of the first method, resolution is degraded to one fourth, roughness is remarkable, therefore, it is unsatisfied to print out the national image.

The inventors and so on of the present invention have proposed a two fluids mixing type printer apparatus that a diluent fluid that discharges at once the diluent ink which is made by mixing the ink and the diluent fluid of a transparent solvent at the fixed mixing rate just before discharge and records by adhering it on the recorded material as shown in, for example, Special Disclosed Patent Bulletin No. Hei 5-201024 for making clear principally problems of the conventional on-demand type printer apparatus which discharges only the ink. Of the methods, the method which records by discharge the discharge medium as the ink is the quantitative medium, the diluent fluid is the discharge medium, and the ink of the quantitative medium is the diluent ink by mixing with the diluent fluid of the discharge medium is called the carrier discharge method, however, in the printer apparatus, it is no problem even if the diluent fluid is the quantitative medium and the ink is the discharge medium.

In the printer apparatus of the carrier discharge method, it is possible to control the concentration of the drop of the discharged diluent ink, to change the concentration per dot printed, and to print out the national images that the intermediate gradation is rich without generating degradation of the resolution.

As the two fluids mixing type printer apparatus, the printer is given that includes a first pressure room into which the quantitative medium, a second pressure room into which the discharge medium is introduced, a first nozzle communicated with the first pressure room and a second nozzle communicated with the second pressure room which are opened side by side, makes the quantitative medium leak out from the first nozzle through a nozzle opening surface to the second nozzle, contacts with the discharge medium filled in the neighborhood of the end of the second nozzle, and discharges the quantitative and the discharge medium as the mixed solution by discharge the discharge medium of the fixed quantity from the second nozzle. That is to say, in this printer, the gradation is represented by changing the concentration of the ink of the drop of the mixed fluid per dot by mixing with the diluent fluid or the ink which is the discharge medium of the fixed quantity by changing the fixed quantity of the ink or diluent which is the quantitative medium.

The printer apparatus includes a first pressure applying means which applies pressure to the quantitative medium in the first pressure room and a second pressure applying means which applies the pressure to the discharge medium in the second pressure room, makes the quantitative medium leak out from the first nozzle communicated with the quantitative medium by applying the pressure to the quantitative medium in the first pressure room by the first pressure applying means, and makes the getting medium leak out from the second nozzle communicated with the discharge medium by applying the pressure to the discharge medium in the second pressure room by the second pressure applying means.

As the first and second pressure applying means, piezoelectric elements and so on are given to be expanded and constricted by changing driving voltage, to apply the pressure to the first and the second pressure rooms and to apply the pressure to the quantitative medium and the discharge medium filled in them. In the pressure applying means, quantity and so on of the quantitative medium leaked to the first nozzle by the pulse width and so on are regulated.

Actuation of the printer is regulated by timing of changing the driving voltage of the first and the second pressure applying means is regulated. That is to say, if the actuation to push out the quantitative medium from the first nozzle to the second nozzle by changing the driving voltage of the first pressure applying means from a stationary state to the fixed voltage and the actuation to push out the quantitative medium with the discharging medium from the second nozzle by changing the driving voltage of the second pressure applying means from the stationary state to the fixed voltage is not executed at proper timing, it is impossible to form the dot of the accurate concentration of the ink.

For example, when changing the driving voltage of the second pressure applying means and discharge the discharge medium before the quantitative medium leaked from the first nozzle is contacted with the discharge medium in the neighborhood of the end of the second nozzle, it is easily impossible to mix all of the fixed quantity of the quantitative medium with the discharge medium and to form the dot of the accurate concentration of the ink. Further, the unmixed quantitative medium remains on the opening surface of the nozzle, and it causes inconvenience to be mixed with the mixed drop of fluid of next time and so on.

SUMMARY OF THE INVENTION

The present invention is proposed considering the conventional actual situation, and an object of the present invention is to provide a driving method of an printer apparatus possible to form surely dot of accurate concentration and to execute surely mixing and discharging actuation without mixing a medium of a fixed quantity into the next dot.

In order to achieve the object, a driving method of a printer apparatus according to the present invention includes a print head including a first pressure room into which a quantitative medium is introduced, a second pressure room into which a discharge medium is introduced, a first nozzle communicated with the first pressure room and a second nozzle communicated with the second pressure room formed wherein they are penetrated through a plate matter and opening parts of both nozzles are side by side, a first pressure applying means for pushing out the quantitative medium by applying pressure to the quantitative medium in the first pressure room and a second pressure applying means for discharge the discharge medium by applying pressure to the discharge medium in the second pressure room, the driving method characterized by including a process for making the first pressure applying means execute pushing out actuation from a stationary state and for making the quantitative medium leak out from the first nozzle to the opening part of the second nozzle on the plate matter and a process for making the second pressure applying means execute discharge actuation from the stationary state and for discharge the quantitative medium and the discharge medium by making the discharge medium discharge from a opening part of the second nozzle, and characterized by finishing the discharge actuation of the second pressure applying means after the pushing out actuation of the first pressure applying means.

DESCRIPTION OF THE PREFERRED EMBODIMENTS

Embodiments of the present invention will be described below with reference to the accompanying drawings. First, a printer apparatus for which a driving method according to the present invention is applicable is described. However, an example of a print head of a printer apparatus of so-called a carrier discharge method to mix a diluent fluid with ink and discharge them and is described, and an example of the print head having plural sets of nozzles is described. The print head, as shown in FIG. 1, includes a pressure room unit 1 which mixes the ink with the diluent fluid and discharge them and has two pressure rooms, and a second piezoelectric unit 2 and a first piezoelectric unit 3 corresponding to the two pressure rooms.

Figure 1:
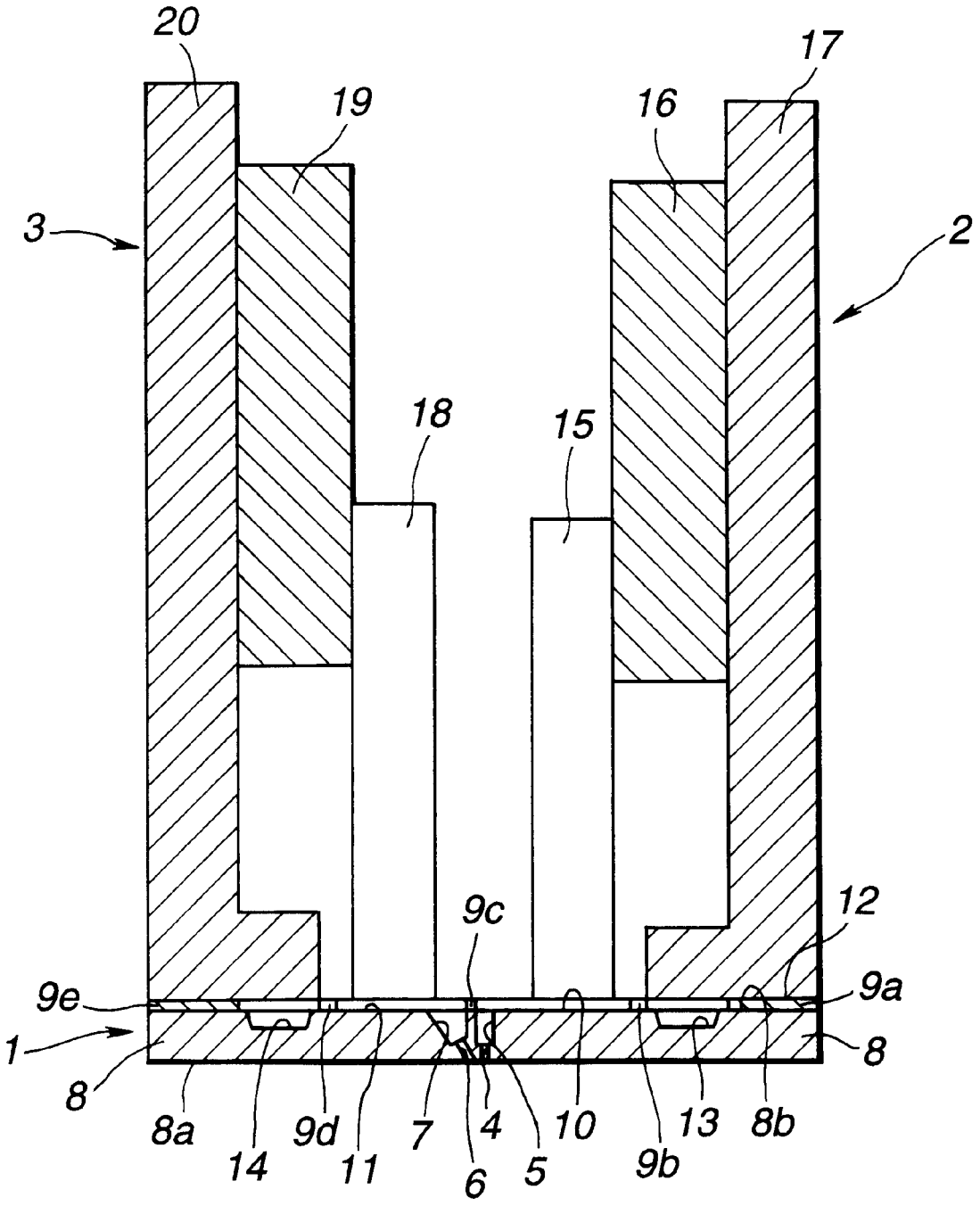
FIG. 1 is a schematic cross section of a main part showing an example of a print head of the printer apparatus for which a driving method of a printer apparatus according to the present invention is applicable.
Figure 2:
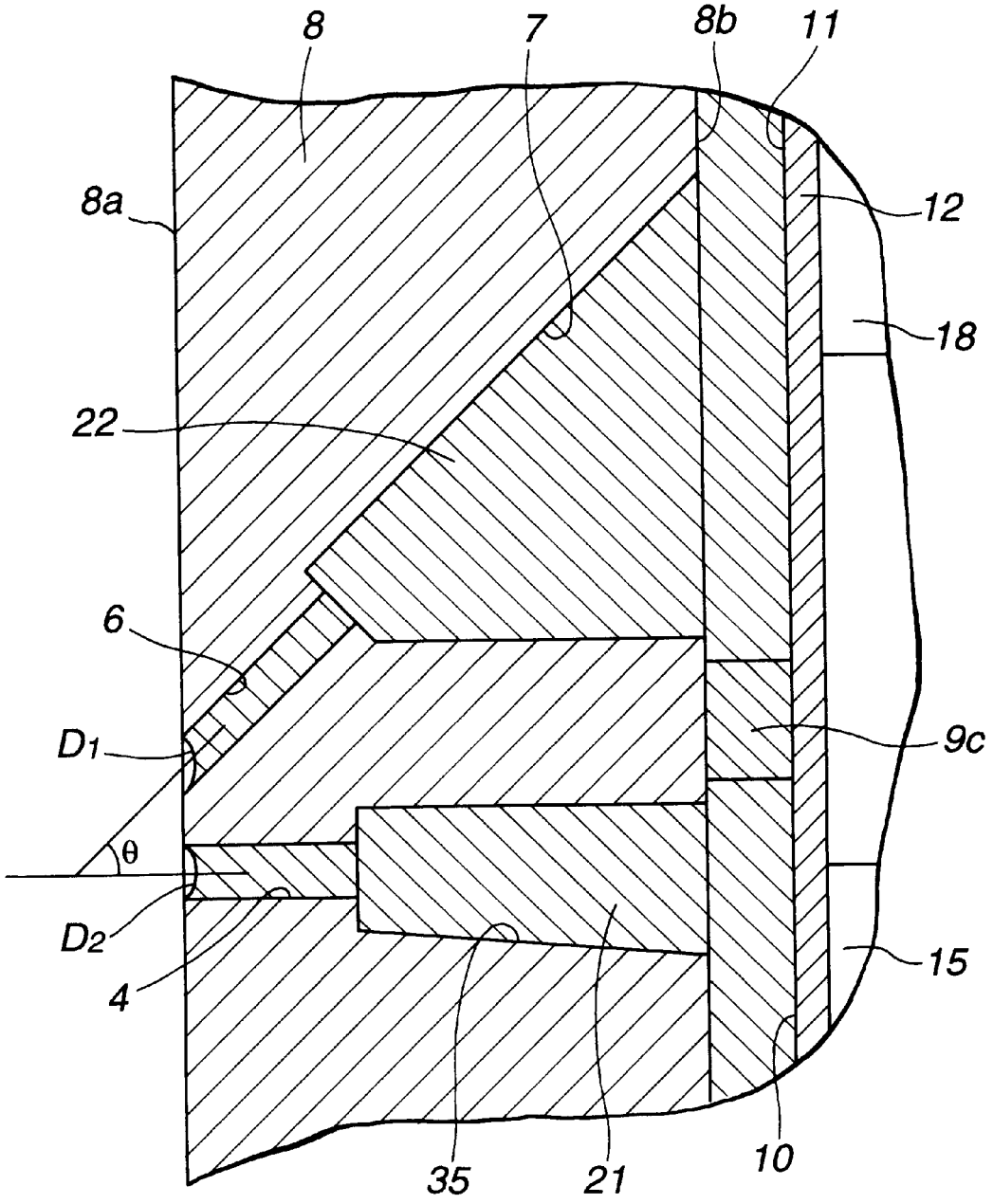
FIG. 2 is a schematic cross section of a main part showing enlarged neighborhood of an orifice plate of an example of a print head of the printer apparatus for which a driving method of a printer apparatus according to the present invention is applicable.

The pressure room unit 1, as above mentioned, mixes the ink with the diluent fluid and discharges them includes an orifice plate 8 almost at the center of which a second nozzle 4 which is an outlet of the diluent fluid, a second inlet 5 communicated with the second nozzle 4, a first nozzle 6 which is an outlet of the ink and an inlet 7 communicated with the first nozzle are formed inside as enlarged and shown in FIG. 2, a second pressure room 10 which is the pass of diluent fluid by forming walls 9*a*, 9*b*, 9*c*, 9*d* and 9*e* on the side of the pressure room as diaphragms as shown in FIG. 1, a first pressure room 11 which is the pass of the ink and a vibration plate 12.

Further, in the orifice plate 8, as enlarged and shown in FIG. 2, ends of the first and the second nozzle 6 and 4 are faced a main surface 8*a* which is a printing surface 8*a*, and ends of the first and the second, inlet 7 and 5 which are communicated with the the first and the second nozzle 6 and 4 are faced a back surface 8*b* opposite to the the main surface 8*a*. Therefore, the second inlet 5 and the second nozzle 4 are penetrated through the orifice plate 8 as a whole, and the first inlet 7 and the first nozzle 6 are also penetrated through the orifice plate 8 as a whole. Further, the first and the second nozzle 6 and 4 are formed at the angle of 45 degrees between these opening directions shown by θ in FIG. 2, and these are a set of nozzles.

Further, in the orifice plate 8, as shown in FIG. 1, a second supplying room 13 the cross section of which is U-shape which is a diluent fluid bank is formed faced to a back surface 8*b* which is opposite to a main surface 8*a* the opening part of which is a printing surface in order to put the first and the second nozzle 6, 4 and the first and second inlet 7 and 5 between them.

Then, walls 9*a*, 9*b*, 9*c*, 9*d* and 9*e* on the side of the pressure room are accumulated as the diaphragms on the side of the back surface 8*b* of the orifice plate 8, the opening part of the second supplying room 13 is connected with the opening part of the second inlet 5 by the parts where the walls 9*a*, 9*b*, 9*c*, 9*d* and 9*e* on the side of the pressure room are not formed, the second pressure room 10 which is the pass is formed, the opening part of the first supplying room 14 is connected with the opening part of the first inlet 7, and the first pressure room 11 which is the pass is formed.

The vibration plate 12 is accumulated on the walls 9*a*, 9*b*, 9*c*, 9*d* and 9*e* on the side of the pressure room and the the first and the second pressure room 11 and 10 are sealed.

Further, the second piezoelectric unit 2 includes a second accumulated piezoelectric element 15 which is a plate which piezoelectric and conductive materials are accumulated alternatively, a second supporting body 16 by which one end of the second accumulated piezoelectric element 15 is fixed, and a second holder 17 which fixes the second supporting body 16 by which the second accumulated piezoelectric element 15 is fixed to the pressure room unit 1. On one hand, in the same way in the first piezoelectric unit 3, an end of a first accumulated piezoelectric element 18 is fixed to a first supporting body 19, and these are fixed to the pressure room unit 1 by a first holder 20.

As the first and the second accumulated piezoelectric element 18 and 15, any of the piezoelectric element that the piezoelectric and the conductive material are accumulated perpendicularly to the longitudinal direction of the first and the second pressure room 11 and 10 or that the piezoelectric element that they are accumulated in parallel with the longitudinal direction of them. The accumulated piezoelectric element has a characteristic that it is extended in the accumulated direction when applying voltage.

Therefore, the former accumulated piezoelectric elements are extended in the longitudinal direction of the first and the second pressure room 11 and 10 by applying the voltage, on the other hand, are constricted in the perpendicular direction of them. Therefore, the accumulated piezoelectric elements do not give pressure to the pressure room. The accumulated piezoelectric elements are called the accumulated piezoelectric elements of $d_{31}$ mode.

One the other hand, the later accumulated piezoelectric elements are extended perpendicularly to the longitudinal direction of the first and the second pressure room 11 and 10 and apply the pressure to the pressure room. The accumulated piezoelectric elements are called the accumulated piezoelectric elements of $d_{33}$ mode.

The second accumulated piezoelectric elements 15 is disposed opposite to the second pressure room 10 through the vibration plate 12, and the first accumulated piezoelectric elements 18 is also disposed the first pressure room 11 through the vibration plate 12.

Therefore, in the print head formed as above mentioned, the diluent fluid is supplied from a diluent fluid tank (not shown) through a duct and a supplying groove (not shown) to the second supplying room 13, as shown in FIG. 2, is filled from here through the second pressure room 10 into the second nozzle 4 which is communicated with the second outlet 5, and the second meniscus $D_2$ is formed at the end part of the second nozzle 4 by the respective diluent fluid 21.

Similarly in the other ink, the diluent fluid is supplied from an ink tank (not shown) through the duct and the supplying groove (not shown) to the first supplying room 14, as shown in FIG. 2, is filled from here through the first pressure room 11 into the first nozzle 6 which is communicated with the first outlet 7, and the second meniscus $D_1$ is formed at the end part of the first nozzle 6 by ink 22.

Further, in the print head, as above mentioned, plural sets of nozzles including the first nozzle 6 and the second nozzle 4 are disposed side by side. That is to say, as shown in FIG. 3, seeing from the side of a main surface 8*a* of the orifice plate 8 of the print head, plural sets of nozzles 30 including the first and the second nozzles 6 and 4 are disposed side by side.

Figure 3:
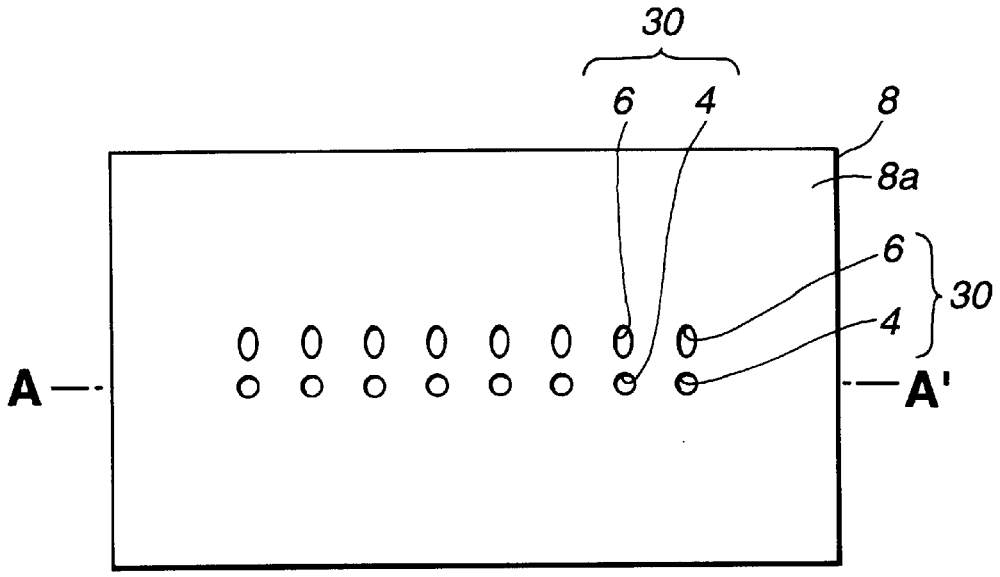
FIG. 3 is a plane view showing an example of a print head of the printer apparatus for which a driving method of a printer apparatus according to the present invention is applicable.
Figure 4:
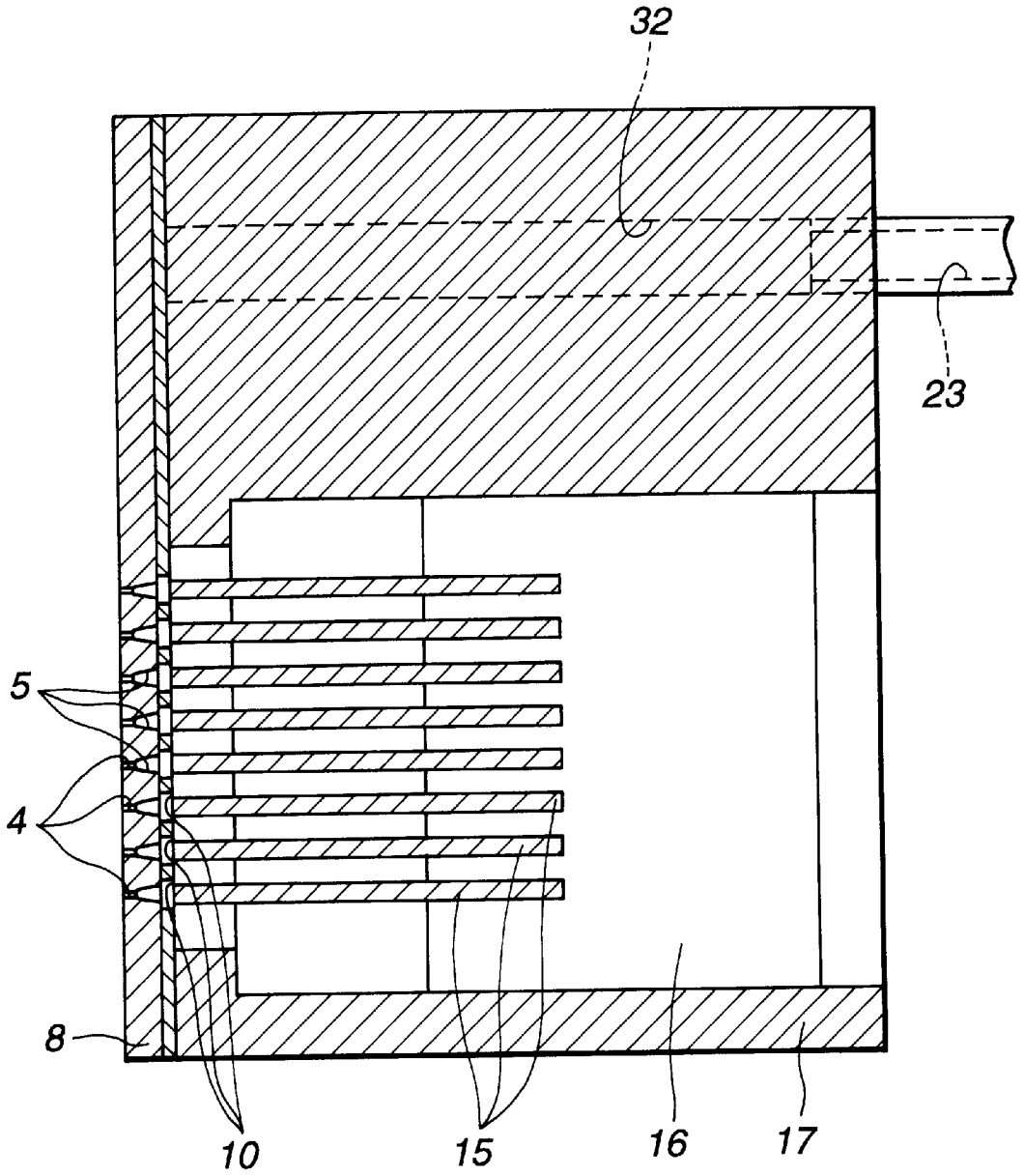
FIG. 4 is a cross section showing an example of a print head of the printer apparatus for which a driving method of a printer apparatus according to the present invention is applicable.

Further, though the cross section that the print head is cut by a line shown by A—A' in FIG. 3, on the orifice plate 8 plural nozzles 4 which are communicated with the second inlets 5 are disposed side by side, and plural second pressure rooms 10 which are communicated with them are also disposed side by side. Further, plural accumulated piezoelectric elements 15 opposite to the plural second pressure rooms 10 are also disposed side by side, one side of ends of them is supported by the second supporting body 16, and the second supporting boy 16 is fixed by the second holder 17.

In the print head, there is also formed the second duct 23 which connects a first duct 32 which supplies the diluent fluid to the second supplying room (not shown) with a diluent tank (not shown) which is outside. Further, the same structure is on the side of the first nozzle 6 of the print head.

Figure 5:
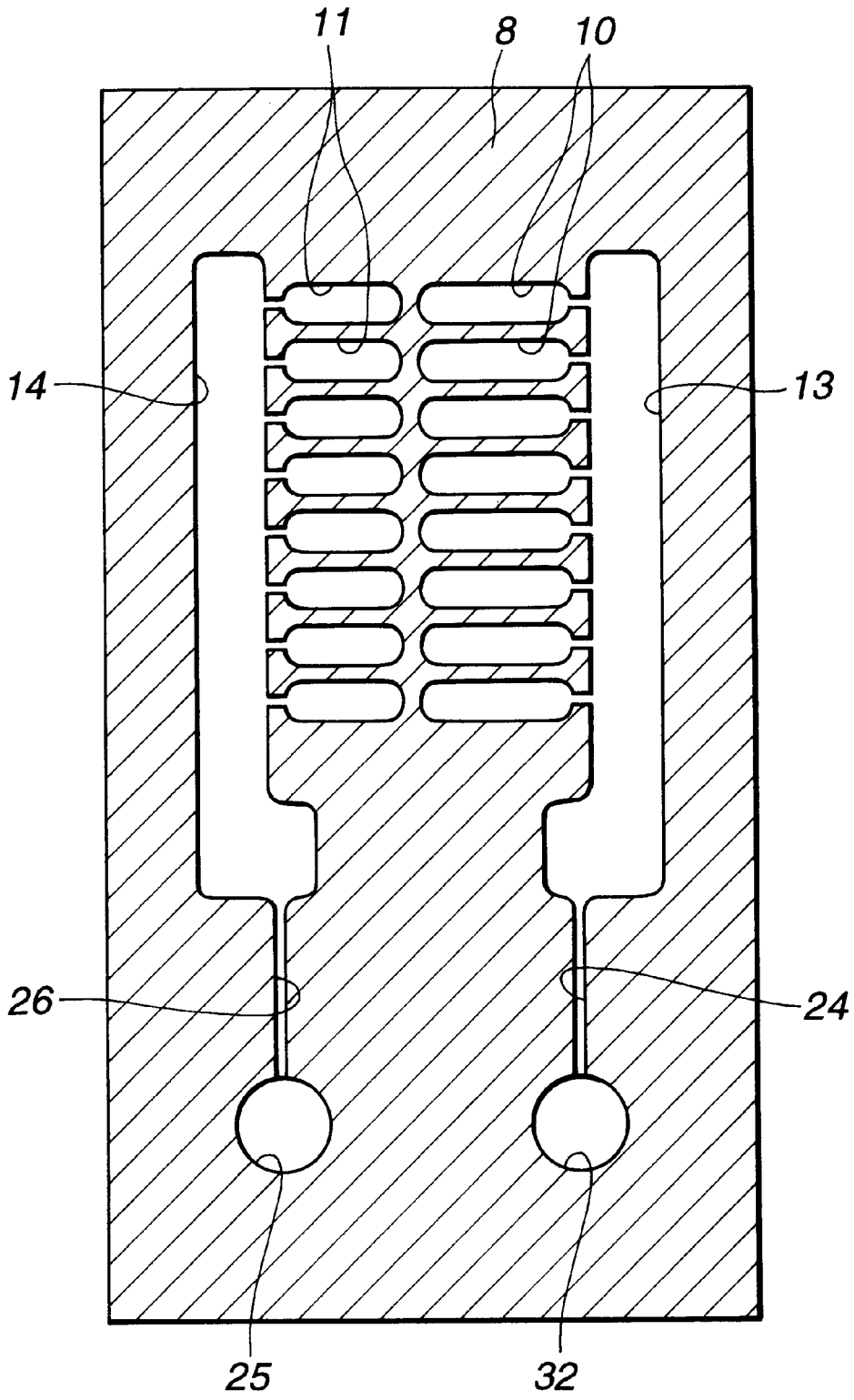
FIG. 5 is a cross section showing an orifice plate of an example of a print head of the printer apparatus for which a driving method of a printer apparatus according to the present invention is applicable.

Next, though a cross section that the orifice plate 8 is cut in the neighbor hood of the first and the second pressure room 11 and 12 is shown in FIG. 5, the size of the second supplying room 13 is corresponding to that of plural second pressure rooms 10, the supplying room 13 is formed at the corresponding position, these second pressure rooms 10 are connected with the second supplying room 13 respectively, and the second supplying room 13 is connected through the first supplying groove 24 with the first duct 32.

On one hand, the size of the first supplying room 14 is corresponding to that of plural first pressure rooms 11, the supplying room 14 is formed at the corresponding position, these first pressure rooms 11 are connected with the first supplying room 14 respectively, and the first supplying room 14 is connected through the second supplying groove 26 with the third duct 32. Then, the third duct 25 is similarly connected through a fourth duct (not shown) with the outside ink tank and the first duct 32.

Figure 6:
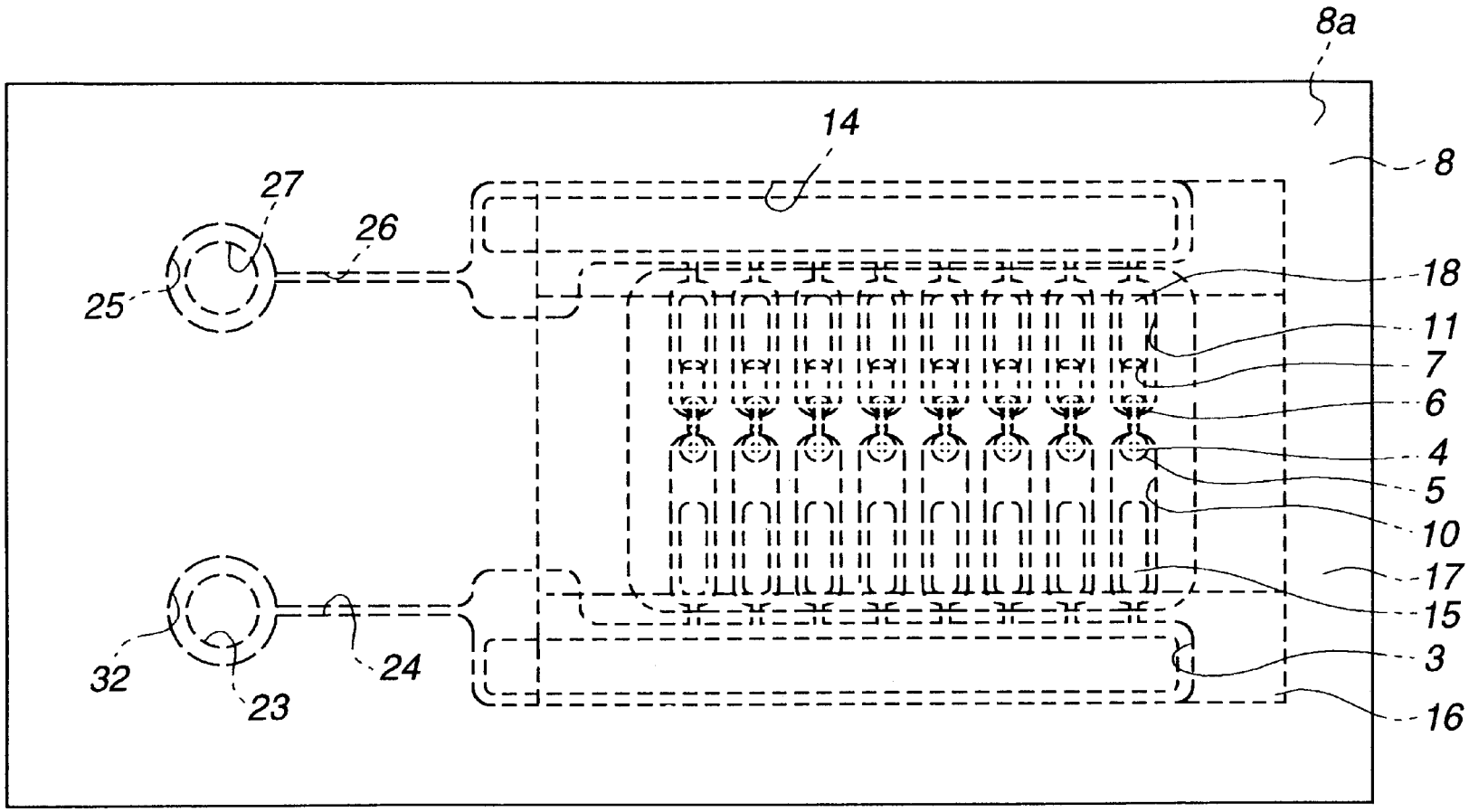
FIG. 6 is a cross section showing schematically an example of a print head of the printer apparatus for which a driving method of a printer apparatus according to the present invention is applicable.

Next, though FIG. 6 is shown that the print head 3 is seen from the side of a main surface 8*a* of the orifice plate 8, for example, the second nozzle 4 is communicated through the second inlet 5 on side of a main surface 8*a* of the second pressure room, and the second accumulated piezoelectric element 15 is disposed on the opposite side of the second nozzle 4 of the second pressure room 10.

Therefore, the diluent fluid which is supplied from a diluent fluid tank (not shown) through the second duct 23, the first duct 32 and the first supplying groove 24 to the second supplying room 13 is supplied to the plural second pressure rooms 10 respectively, and is filled in the second nozzle 4 communicated with the second inlet 5 corresponding to each of the second pressure rooms 10 respectively. Further, when deforming each of the second accumulated piezoelectric elements 15 corresponding to each of the pressure rooms 10 and pressurizing the second pressure rooms 10 respectively, the diluent fluid is discharged from the second nozzles 4 communicated with the second pressure rooms 10 on the opposite side of the second accumulated piezoelectric element 15 respectively.

That is to say, when deforming all of the plural second accumulated piezoelectric element 15 and pressurizing the plural second pressure rooms 10, the diluent fluid is discharged from the plural second nozzles 4 at a time, and when deforming the selected second accumulated piezoelectric element 15, the diluent fluid is discharged from the selected second nozzle 4 corresponding to this.

What is above mentioned is similar on the side of the first pressure room 11, the first nozzle 6 is communicated through the first inlet 7 on the side of a main surface 8*a* of the first pressure room 11, and the first accumulated piezoelectric element 18 is disposed on the opposite side of the first nozzle 6 of the first pressure room 11.

Therefore, the ink which is supplied from a ink tank (not shown) through the fourth duct 27, the third duct 25, and the second supplying groove 26 to the first supplying room 14 is supplied to the plural first pressure rooms 11 respectively, and is filled in the first nozzle 6 communicated with the first inlet 7 corresponding to each of the first pressure rooms 11 respectively. Further, when deforming each of the first accumulated piezoelectric elements 18 corresponding to each of the first pressure rooms 11 and pressurizing the first pressure rooms 11 respectively, the ink is discharged from the first nozzles 6 communicated with the first pressure rooms 11 on the opposite side of the first accumulated piezoelectric element 18 respectively.

That is to say, when deforming all of the plural first accumulated piezoelectric element 18 and pressurizing the plural first pressure rooms 11, the ink is discharged from the plural first nozzles 6 at a time, and when deforming the selected first accumulated piezoelectric element 18, the ink is discharged from the selected first nozzle 6 corresponding to this.

Figures 7A, 7B:
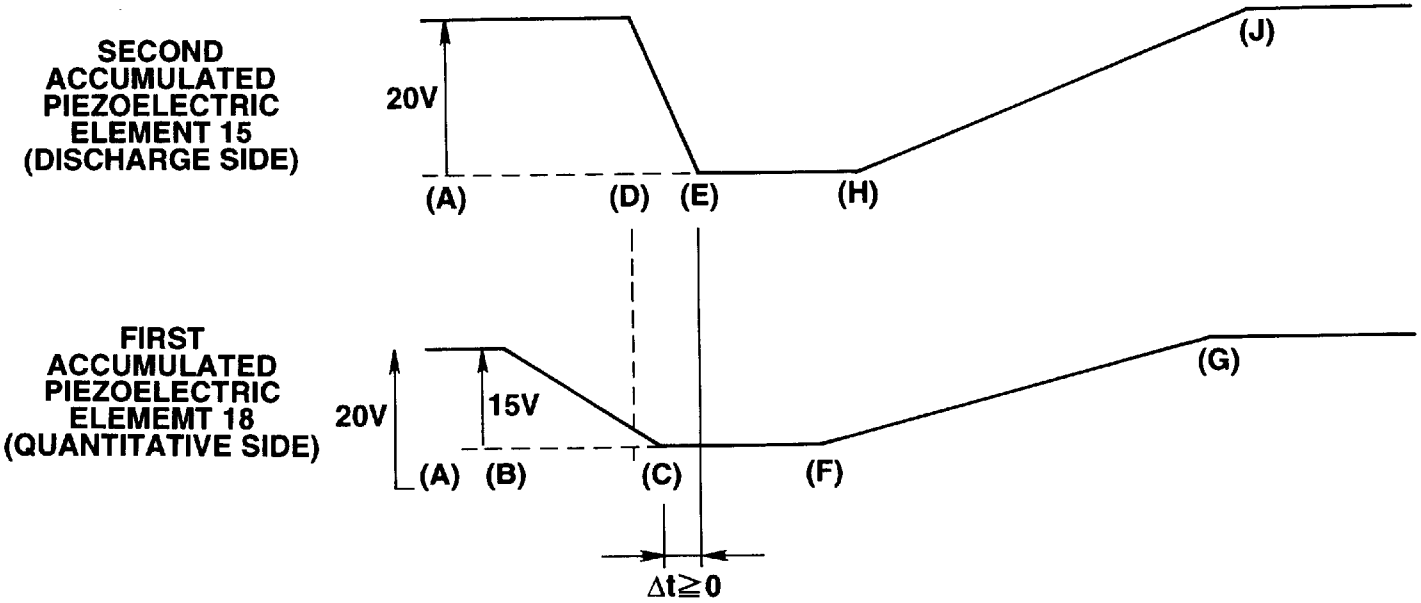
FIG. 7 is a view showing a driving wave form of an example of a printer apparatus according to the present invention.
Figure 8:
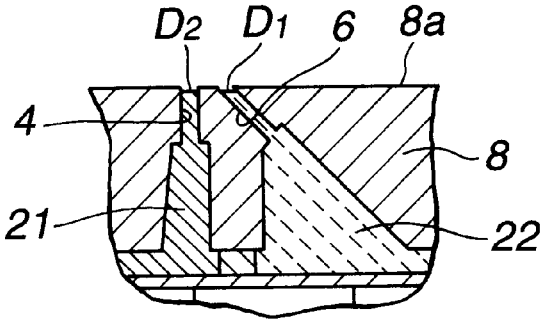
FIG. 8 is a cross section showing operation in order in printing of a print head of the printer apparatus for which a driving method of a printer apparatus according to the present invention is applicable, and showing schematically the state that a first and a second meniscus are formed in a first and a second nozzle.

Next, actuation of the printer apparatus will be described referring to applying timing of driving voltage based on the driving method according to the present invention. Here, the case that so-called accumulated piezoelectric element of $d_{31}$ mode is used as the first and the second accumulated piezoelectric element 18 and 15 is described. That is to say, as shown in FIG. 7A, for example, 20 [V] have previously been applied to the second accumulated piezoelectric element 15 at the point of time shown by (A) in FIG. 7 during waiting before printing, and as shown in FIG. 7B, for example, 20 [V] have previously been applied to the first accumulated piezoelectric element 18 at the point of time shown by (A) in FIG. 7B during waiting before printing. Then, though the neighborhood of the first and the second nozzle 6 and 4 is schematically enlarged and is shown in FIG. 8, the second meniscus $D_2$ is formed on the side of a main surface 8*a* of the second nozzle 4 formed on the orifice plate 8, and the first meniscus $D_1$ is formed on the side of a main surface 8*a* of the first nozzle 6 formed on the orifice plate 8.

Figure 9:
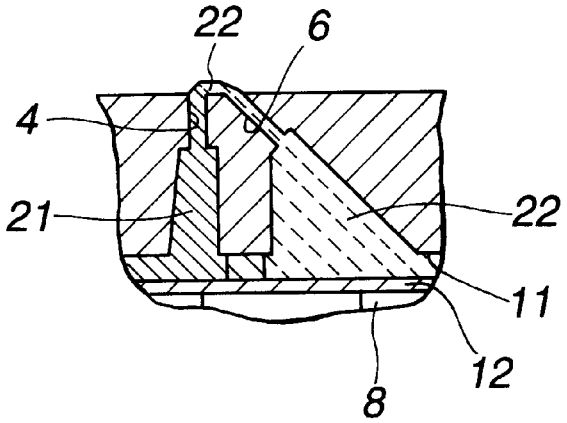
FIG. 9 is a cross section showing operation in order in printing of a print head of the printer apparatus for which a driving method of a printer apparatus according to the present invention is applicable, and showing schematically the state that ink is met with diluent fluid in a second nozzle.

First, in order to push and leak out the ink 22 from the first nozzle 6 according to the signal from head drive, head feeding control, drum rotating control and so on provided in the printer apparatus during printing, the voltage of the first accumulated piezoelectric element 18 is gradually reduced to 5 [V] for 50 [μsec] from the point of time as shown in (B) of FIG. 7B to the point of time as shown in (C) of FIG. 7B. Then, the first accumulated piezoelectric element 18 is longitudinally and gradually extended, the first pressure room 11 is gradually pressurized through the vibration plate 12 as schematically shown in FIG. 9, the inner pressure is applied to the first nozzle 6, and the ink 22 is oozed out from the outside of the first nozzle 6 to the neighborhood of the opening of the second nozzle 4 and is met the diluent fluid 21 of the second nozzle 4.

Figure 10:
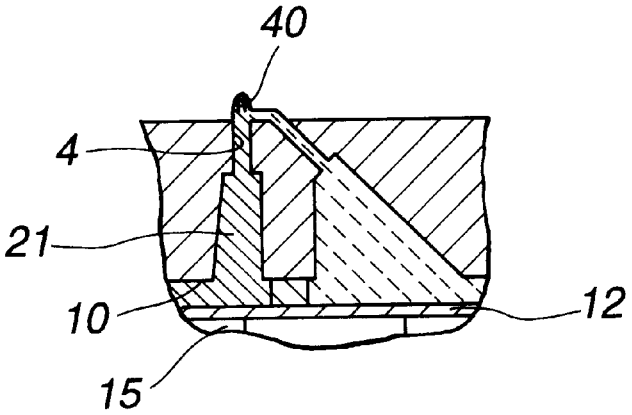
FIG. 10 is a cross section showing operation in order in printing of a print head of the printer apparatus for which a driving method of a printer apparatus according to the present invention is applicable, and showing schematically the state that mixed fluid is made of a diluent fluid and ink.

Further, as shown in FIG. 7A, the voltage of the second accumulated piezoelectric element 15 is started to reduce gradually from the point of time as shown in (D) of FIG. 7A before the point of time as shown in (C) of FIG. 7B. However, this actuation is executed after the ink 22 is contacted with the diluent fluid 21. Then, the second accumulated piezoelectric element 15 is started to extended longitudinally, the second pressure room 10 is pressurized through the vibrating plate 12, and the inner pressure is started to apply to the second nozzle 4. The voltage is gradually reduced to the point of time as shown in (E) of FIG. 7A after the point of time as shown in (C) of FIG. 7B for 10 [μsec]. (That is to say, $\Delta t \geqq 0$) That is, after pushing out actuation of the ink by the first accumulated piezoelectric element 18 has been finished, discharge actuation of the second accumulated piezoelectric element 15 is finished. Then, as shown in FIG. 10, the diluent fluid 21 is pushed out from the second nozzle 4, thus, a mixed fluid 40 including the ink is pushed out of the second nozzle 4.

Further, as shown in FIG. 7B, after holding the first accumulated piezoelectric element 18 from the point of time as shown by (C) in FIG. 7B to the point of time as shown by (F) of FIG. 7B for 50 [μsec], the voltage is returned to the previous voltage from the point of time as shown by (F) in FIG. 7B to the point of time as shown by (G) in FIG. 7B for 150 [μsec]. Then, the first accumulated piezoelectric element 18 is started to constricted gradually and the ink 22 is drawn into the first nozzle 6.

Further, as shown in FIG. 7A, after holding from the point of time as shown by (E) in FIG. 7A to the point of time as shown by (H) in FIG. 7A for 50 [μsec], the voltage is returned gradually to the previous voltage from the point of time as shown by (H) in FIG. 7A to the point of time as shown by (J) in FIG. 7A for 150 [μsec]. Then, the first accumulated piezoelectric element 15 is started to constricted gradually and the diluent fluid 21 is drawn into the second nozzle 4.

Figure 11:
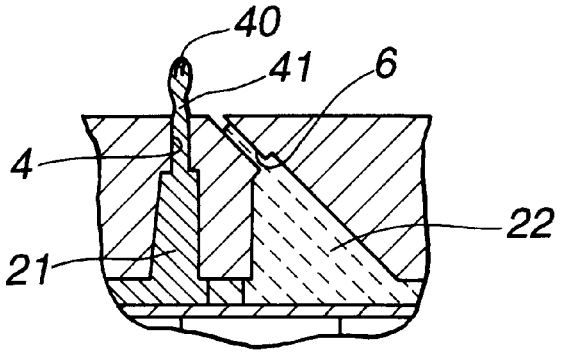
FIG. 11 is a cross section showing operation in order in printing of a print head of the printer apparatus for which a driving method of a printer apparatus according to the present invention is applicable, and showing schematically the state that a mixed fluid is constricted.

That is to say, when returning gradually the voltage, as shown in FIG. 11, the ink 22 is drawn into the first nozzle 6, is separated from the remained ink as the mixed fluid 40, the diluent fluid 21 is also drawn into the second nozzle 4 and constriction 41 is caused between the mixed fluid 40 and the diluent fluid 21 in the second nozzle 4.

Figure 12:
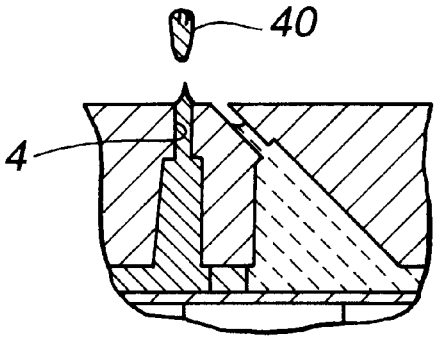
FIG. 12 is a cross section showing operation in order in printing of a print head of the printer apparatus for which a driving method of a printer apparatus according to the present invention is applicable, and showing schematically the state that a mixed fluid is discharged from a second nozzle.
Figure 13:
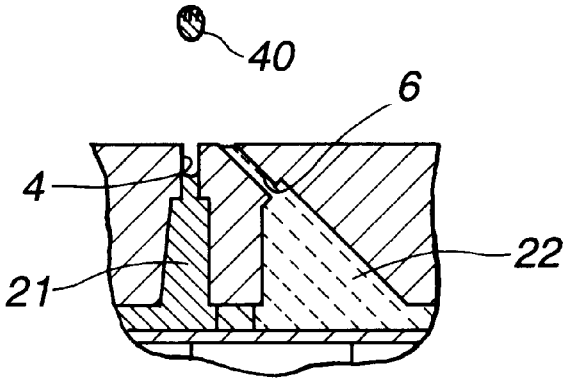
FIG. 13 is a cross section showing operation in order in printing of a print head of the printer apparatus for which a driving method of a printer apparatus according to the present invention is applicable, and showing schematically the state that a mixed fluid is flown as a spherical fluid drop.

Further, when continuing this state, the mixed fluid 40 is separated from the diluent fluid 21, as shown in FIG. 12, the mixed fluid 40 is discharged from the nozzle 4, as shown in FIG. 13, the mixed fluid 40 is spherical and continued flying to the recorded material and is adhered on the recorded material, and recording is executed. This actuation is finished before each of voltages are turned to the previous state.

When the driving voltage of the first accumulated piezoelectric element 18 and the second accumulated piezoelectric element 15 are returned to the former state, the first nozzle 6 is filled with the ink 22 by a capillary phenomenon again, the second nozzle 4 is filled with the diluent fluid 21 again, the meniscuses are formed respectively, and each voltage is returned to the state in FIG. 8.

In the driving method of the printer according to the present embodiment, after making the first accumulated piezoelectric element 18 push out from the stationary state, making the ink 22 leak out of the first nozzle 6 to the second nozzle 4, and contacting the respective ink 22 with the diluent fluid 21 in the neighborhood of the end of the second nozzle 4, it makes the second accumulated piezoelectric element 15 execute the discharge actuation from the stationary state, making discharge the diluent fluid 21 from the second nozzle 4, mixing the ink 22 with the diluent fluid 21, therefore, only the diluent fluid 21 does not be discharged.

Further, as the discharge actuation of the second accumulated piezoelectric element 15 is finished after finishing the pushing out actuation of the first accumulated piezoelectric element 18, the ink 22 is not remained on a main surface 8*a* which is the nozzle opening surface.

Therefore, in the driving method according to the present embodiment, it is possible to form surely a dot of accurate concentration, a quantitative medium is not mixed into the next dot and so on, and it is possible to execute surely the mixing and the discharge actuation.

Further, in the driving method according to the present embodiment, after pushing out the ink 22, the discharge actuation of the second accumulated piezoelectric element 15 is finished before returning gradually the voltage of the first accumulated piezoelectric element .18 to the previous state, returning gradually the pressure to the stationary state and finishing the filling actuation which fills the ink 22 into the first nozzle 6, therefore, it is possible to move quickly to the next mixing and discharge actuation.

Further, in the driving method according to the present embodiment, before starting the filling actuation of the first accumulated piezoelectric element 18, that is to say, returning the voltage of the first accumulated piezoelectric element 18 to the previous state, the discharge actuation of the second accumulated piezoelectric element 15 is finished, it is possible to repeat quickly the mixing and discharge actuation.

As it is clear from the description that, in the driving method according to the present invention, when driving the printer apparatus including the print head including the first pressure room into which the quantitative medium is introduced, the first nozzle communicated with it, the second pressure room into which the discharge medium is introduced, the second nozzle communicated with it, a first pressure applying means pushing out the quantitative medium and the second pressure applying means discharge out the discharge medium, after making the first pressure applying means executing the pushing out actuation from the stationary state, leaking the quantitative medium from the first nozzle to the second nozzle and contacting the respective quantitative medium of with the discharge medium in the neighborhood of the end of the second nozzle, it makes the second pressure applying means execute the discharge actuation from the stationary state and mixes and discharges the quantitative medium and the discharge medium by discharge the discharge medium from the second nozzle, therefore, only the discharge medium is not discharged, further, as the discharge actuation of the second pressure applying means is finished after finishing the pushing out actuation of the first pressure applying means, the quantitative medium is not remained on the opening surface of the nozzle.

Therefore, in the driving method according to the present invention, it is possible to form surely the dot of the accurate concentration and to execute surely the mixing and discharge actuation without mixing the quantitative medium into the next dot and so on.

Further, in the driving method according to the present invention, if finishing the discharge actuation of the second pressure applying means before finishing the filling actuation for filling the quantitative medium into the first nozzle by returning gradually the pressure of the pressure applying means to the stationary state after pushing out the quantitative medium, it is possible to move quickly to the next mixing and discharge actuation.

Further, in the driving method according to the present invention, if finishing the discharge actuation of the second pressure applying means before starting the filling actuation of the first pressure applying means, it is possible to repeat quickly the mixing and discharge actuation.

What is claimed is:

1. A method for driving a printer apparatus having a print head with a first pressure chamber into which a quantitative medium is introduced, a second pressure chamber into which a discharge medium is introduced, a first nozzle in communication with said first pressure chamber and a second nozzle in communication with said second pressure chamber wherein the first and second nozzles penetrate through a plate member and opening parts of both said first and second nozzles are side by side, a first pressure applying element for pushing out the quantitative medium by applying pressure to the quantitative medium in said first pressure chamber and a second pressure applying element for discharging the discharge medium by applying pressure to the discharge medium in said second pressure chamber, the driving method comprising the steps of:

operating said first pressure applying clement to push out the quantitative medium from a stationary state so as to cause the quantitative medium to ooze from said first nozzle to the opening part of said second nozzle on said plate member;

operating said second pressure applying element to discharge the discharge medium from the opening part of said second nozzle so as to discharge the quantitative medium and the discharge medium; and completing operation of said first pressure applying element is followed by the completion of operation of said second pressure applying element.

2. The method according to claim 1, wherein said first nozzle penetrates through said plate member toward said second nozzle at an incline.

3. The method according to claim 2, wherein said first nozzle penetrates at an angle of about 45 degrees through said plate member toward said second nozzle at an incline.

4. The method according to claim 1, further comprising the step of:

contacting said quantitative medium with said discharge medium before said step of operating said second pressure applying element to discharge of the discharge medium from the opening part of said second nozzle.

5. The method according to claim 1, wherein said first and the second pressure applying elements are laminated piezoelectric elements.

6. The method according to claim 1, further comprising the steps of:

returning pressure of said first pressure applying element to the stationary state following completion of operation of said second pressure applying element and filling the quantitative medium into the first nozzle so that said flingz is finished after a pushing out actuation of the quantitative medium.

7. The method according to claim 6, further comprising the step of:

starting filling actuation of said first pressure applying element after completion of operation of said second pressure applying element.

8. The method according to claim 1, further comprising the step of: starting operation to cause discharge actuation of said second pressure applying element before operation to cause pushing out actuation of said first pressure applying means has been finished.

* * * * *